United States Patent [19]

Lenzing

[11] Patent Number: 4,577,146

[45] Date of Patent: Mar. 18, 1986

[54] VARIABLE AUTOTRANSFORMER HAVING AN INDEXED STEPPING BRUSH

[75] Inventor: Richard S. Lenzing, Farmington, Conn.

[73] Assignee: The Superior Electric Company, Bristol, Conn.

[21] Appl. No.: 620,375

[22] Filed: Jun. 12, 1984

Related U.S. Application Data

[63] Continuation-in-part of Ser. No. 416,718, Sep. 13, 1982, abandoned.

[51] Int. Cl.[4] ..... G05F 1/14

[52] U.S. Cl. ..... 323/341; 336/149

[58] Field of Search ..... 323/255, 256, 257, 340, 323/341; 336/148, 149, 150

[56] References Cited

U.S. PATENT DOCUMENTS

| | | | |
|---|---|---|---|
| 920,925 | 5/1909 | Darlington | 323/341 |
| 2,214,864 | 9/1940 | Stonehill | 336/149 |
| 2,273,245 | 2/1942 | Ander | 336/149 |
| 2,812,478 | 11/1957 | Allen | 336/149 |
| 3,016,484 | 1/1962 | Mulder et al. | 336/149 |
| 3,160,842 | 12/1964 | Neumann et al. | 336/148 |

FOREIGN PATENT DOCUMENTS

| | | | |
|---|---|---|---|
| 1087296 | 2/1955 | France | 336/149 |
| 47512 | 4/1980 | Japan | 323/340 |

*Primary Examiner*—William H. Beha, Jr.
*Attorney, Agent, or Firm*—John H. Crozier

[57] ABSTRACT

An adjustable voltage transformer having a commutating surface formed of segments of electrical conductors upon which a contact brush is movable while in electrical engagement therewith. Means are provided to "step" the brush between segments, so that when at rest, the brush contacts no more than one segment, thus reducing short-circuiting currents and overheating; however, when the brush is being moved, it is in contact with two segments, thus allowing uninterrupted output from the transformer.

3 Claims, 7 Drawing Figures

FIG. 1
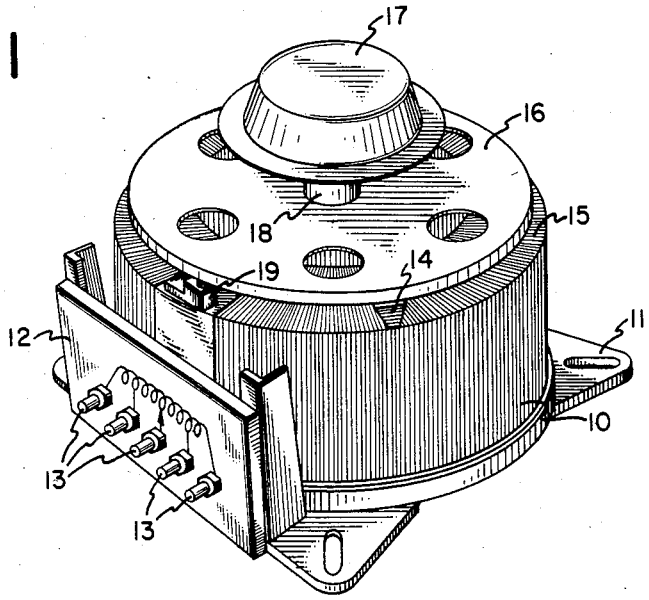
FIG. 2
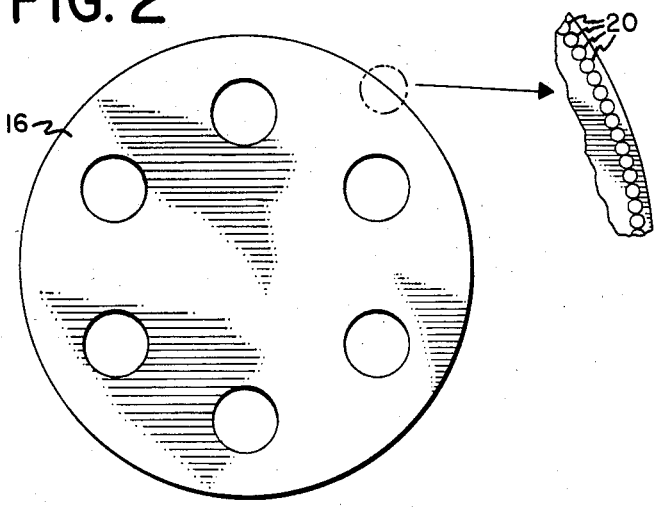
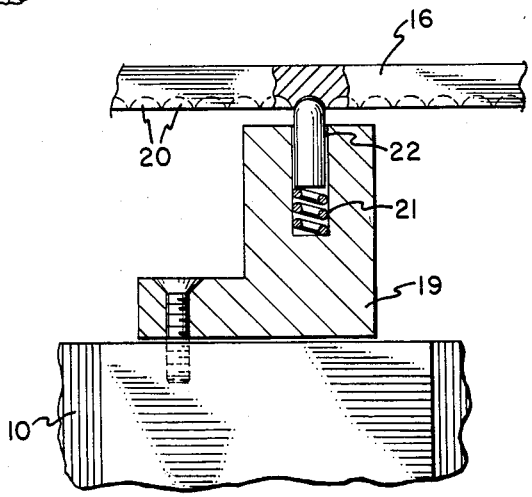
FIG. 3
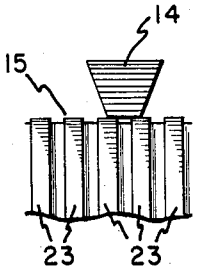
FIG. 4A
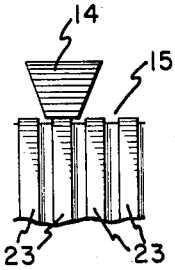
FIG. 4B

VARIABLE AUTOTRANSFORMER HAVING AN INDEXED STEPPING BRUSH

This application is a continuation-in-part of copending application Ser. No. 06/416,718, filed Sept. 13, 1982, now abandoned.

The invention described relates to electrical devices of the type having a commutating surface upon which a contact brush is movable while in electrical engagement therewith, and more particularly to means for reducing the power loss experienced at the brush-commutating surface interface.

Typically, in such devices, the commutating surface along which the brush is moved comprises a plurality of closely spaced segments of an electrical conductor, which segments are at different electrical potentials. As the brush is moved along the commutating surface, the output from the device varies. Most known existing designs of such devices allow the brush to rest at any point along the path of the commutating surface. These designs also permit the brush to contact at least two segments simultaneously, so as to eliminate the possibility of discontinuity in output from the device as the brush is moved along the commutating surface. Since there exists an electrical potential between segments of the conductor, there exists a circulating short-circuit current through the brush between simultaneously contacted segments. Because the brush can span segments indefinitely, the brush/commutating surface contact resistance must be high enough to limit the resultant circulating current to a level that will not overheat the windings and the brush. This contact resistance must also be low enough so as to be able to carry the load current without overheating the brush. Under these conditions, the minimum possible power loss, and consequent heat rise, from this contact resistance is the product of the voltage between contacted commutator segments and the load current. Since the power loss must be limited to prevent burnout, the load current and the voltage between commutator segments must be limited. Limited load current restricts the power that can be handled by the device at any given voltage and limited voltage between commutator segments dictates a design that uses material inefficiently.

One design which eliminates the short-circuit current was disclosed in U.S. Pat. No. 4,189,672. There, the conductor is arranged so that all even-numbered segments comprise on commutating surface and all odd-numbered segments comprise a separate commutating surface. Each commutating surface has a separate brush of such size as to be able to contact only one segment; however, the brushes are arranged so that at least one of the brushes is in contact with one segment at all times, thus eliminating discontinuity in output. The brushes are connected through one or more sets of back-to-back diodes to eliminate short-circuit current, provided that the segment-to-segment potential is less than the potential drop across the two diodes in series. The result is a device which has no short-circuit current, but which is more complicated to construct than most previous devices.

The present invention substantially eliminates the limitations of prior art designs by controlling the movement of a single brush such that, when at rest, the brush contacts one, and only one, commutator segment; but, when being moved, the brush is, at all times, in contact with one or two segments, thereby preventing discontinuity in output; however, the period of time the brush is in contact with any two segments in very brief. As a result, the brush "steps" from one commutator segment to the next. Means for providing the stepping motion may be either mechanical or electromechanical.

The present invention permits such a device to be designed with low brush-commutating surface resistance because the circulating current exists for only a brief period of time, greatly reducing power loss and the consequent overheating. Also, the load current and the voltage between segments can both be increased. Thus, the resulting device can be made smaller, lighter, less expensive, more efficient, and able to handle more power for a given size than equivalent prior art designs.

FIG. 1 is a view of a variable autotransformer employing a mechanical embodiment of the present invention.

FIG. 2 shows the radiator plate of the autotransformer of FIG. 1.

FIG. 3 is a detail of the detent mechanism associated with the autotransformer of FIG. 1.

FIGS. 4A and B shows brush positions obtained when employing the present invention.

Figure 5:
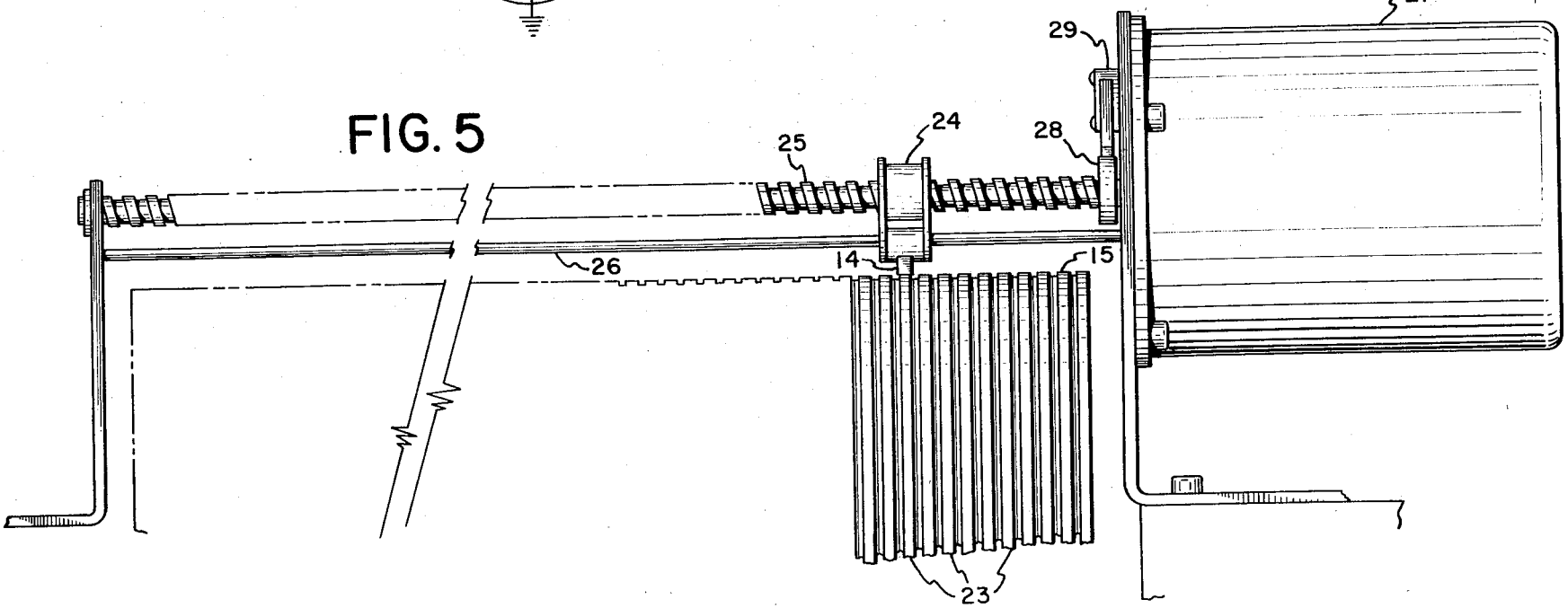

FIG. 5 is a view of a variable autotransformer employing an electromechanical embodiment of the present invention.

Figure 6:
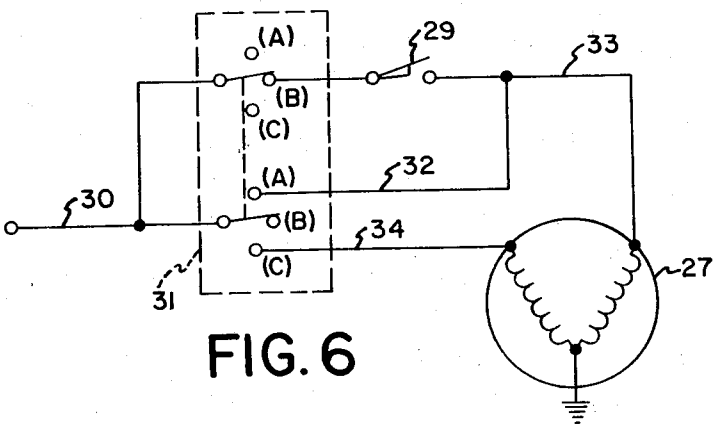

FIG. 6 shows the control circuitry for autotransformer of FIG. 5.

Referring to the Drawing, FIG. 1 is a perspective depicting a mechanical stepping embodiment of the present invention as applied to a conventional, manually-operated, variable autotransformer. A wound core 10 is insulatively mounted on a base 11. A terminal board 12 carries terminals 13 for external electrical connection. A brush 14 is fixed to, and held in slidable electrical engagement with a commutating surface 15 by, a ventilated radiator plate 16. The radiator plate 16 and an insulated knob 17 are fixed to shaft 18 which is mounted centrally of core 10 for rotational movement with respect to the core. A detent block 19 is fixed to an unwound portion of the core 10. FIG. 2 depicts the underside of radiator plate 16 containing a circular row of adjacent, rounded hollows 20 near the outer periphery of the plate. The number of hollows 20 is equal to the number of commutator segments 23 (FIGS. 4 A and B) to be contacted. The angular displacement between hollows 20 relative to the central axis of the shaft 18 is equal to the angular displacement between commutator segments 23 relative to the central axis of the shaft. FIG. 3 is an elevation depicting details of the detect block 19 fixed to the core 10. In block 19 is a spring 21 which urges a round-ended shaft 22 into close-fitting engagement with hollows 20 in plate 16. The hollows 20 are closely spaced such that when the spring-loaded shaft 22 is not in engagement with a hollow, it biases the radiator plate 16 toward such engagement. FIG. 4 is an elevation depicting the brush 14 in engagement with the commutating surface 15. FIG. 4A depicts the brush 14 in simultaneous contact with two commutator segments 23 and FIG. 4B depicts the brush in contact with one commutator segment. The width of the brush 14 is such that it can contact one or two, but no less than one nor more than two, segments 23 at any given position on the commutating surface 15.

The relative dimensions and configurations of the hollows 20, the commutator segments 23, and the brush 14 are such that when the plate 16 is at rest, the shaft 22 engages a hollow, lightly locking the plate in that position, with the brush contacting only one segment, as depicted in FIG. 4B. When the plate 16 is being rotated, the brush 14 may be momentarily in contact with two segments 23, as depicted in FIG. 4A, but is always in contact with at least one segment, as depicted in FIG. 4B. The present invention contemplates that any other type of mechanical detent mechanism may be employed, such as a shaped, spring-biased shaft engaging notches on the periphery of the plate 16, or a mechanical detent mechanism cooperating directly with the shaft 18.

Another preferred embodiment of the present invention including an electromechanical detent mechanism is shown on FIG. 5. Here, the brush 14 moves along, and is in electrical engagement with, the commutating surface 15 which in this case in linear. The brush 14 is held in an internally threaded guide 24 which is in mechanical engagement with a threaded lead screw 25. The guide 24 is in sliding engagement with a guide rod 26 which maintains the brush 14 in position along the commutating surface 15. The pitch of the lead screw 25 is such that one full revolution of the lead screw will move the brush 14 from the center of one of the commutator segments 23 to the center of an adjacent commutator segment. The lead screw 25 is rotated by a reversible electric motor 27. Upon the lead screw 25 is fixed a cam 28 which cooperates with a limit switch 29 which, depending on other electrical elements later described, can stop the motor 27 when the brush 14 is centered on a commutator segment 23.

Circuitry which may be employed in controlling the reversible electric motor 27 is shown in FIG. 6. Power for the motor is supplied through lead 30. The limit switch 29 and a three-way switch, represented by the numeral 31, arranged as shown provide the desired stepping action as is now described. When the three-way switch 31 is moved to position (A), power is supplied to the motor from lead 30, through the switch 31, through lead 32, and through lead 33, causing the motor 27 to rotate and, consequently, through rotation of the lead screw 25, causing the brush 14 to move along the commutator path in one direction. If the three-way switch 31 is moved to position (C), power will be supplied to the motor 27 from lead 30, through the switch 31, through lead 34, and through lead 35, causing the motor 27 to rotate in the direction opposite from that above and, consequently, causing the brush 14 to move along the commutator path in the direction opposite from that above. When, however, it is desired to terminate the movement of the brush, the three-way switch 31 is moved to position (B). If, at that instant the brush 14 is centered on a commutator segment 23 (FIG. 5), the cam 28 will have engaged the limit switch 29, the limit switch will be open, and movement of the brush will terminate. If on the other hand, at the instant when the three-way switch 31 is moved to position (B), the brush 14 is not centered on a commutator segment 23, the limit switch 29 will be closed and power will be supplied to the motor 27 from lead 30, through the three-way switch 31, through the limit switch 29, and through lead 33, causing the motor to rotate in the first direction until the brush 14 becomes centered on a commutator segment 23; at which time, the cam 28 will cause the limit switch 29 to open, thus stopping the supply of power to the motor 27 and causing movement of the brush 14 to terminate.

As is the case with the manually operated detent mechanism described above and shown on FIGS. 2 through 4B, the brush 14 is always in engagement with at least one, but with no more than two, segments; and, when at rest, is in engagement with no more than one segment.

Another embodiment of the present invention includes an electromechanical detent mechanism based on a well-known characteristic of some AC synchronous motors. A typical AC synchronous motor includes a rotor and a stator. The stator includes identical, annular, pole-forming members, with windings adapted to magnetize the pole-forming members, and the pole-forming members having radially inwardly projecting pole pieces with teeth on the inner ends thereof. The rotor includes a permanent magnet structure, axially magnetized, with teeth on the outer ends thereof. When AC voltage is applied to the stator windings, the polarity of the windings changes sequentially such that the rotor revolves in one direction. However, when DC voltage is applied to the windings, a constant polarity results and the rotor will move to the nearest one of a number of "detent positions" and will be held in that position by the interaction of the rotor and stator magnetic fields. The number and location of the detent positions is dependent on the relationship of the rotor teeth to the stator teeth. In the present invention, such a motor is mechanically coupled to the shaft 18 and the relationship of segments 23 and the holding positions of the rotor is arranged such that, at each holding position, the brush 14 is in contact with only one segment. Thus, as with a purely mechanical detent, when the brush 14 is contacting two segments 23, it will always be urged toward the nearest segment, and, when in contact with one segment, it will be held in that position.

Using conventional AC circuitry including reversing switching means, the motor is operated as an AC synchronous motor clockwise or counterclockwise, moving the brush 14 along the commutating surface 15, until the desired output of the device is reached. At that point, the switching means is changed to the "off" state which removes the AC voltage from, and applies a DC voltage to, the stator windings, thus holding the output at the desired value and maintaining the brush 14 in contact with only one segment 23. When the switching is changed to "clockwise" or "counterclockwise" states, the DC voltage is disconnected. The switching means may be mechanical, electromechanical, or electronic.

A further electromechanical embodiment of the present invention is to employ a conventional stepping motor mechanically coupled to the shaft 18 to rotate the shaft in either direction. The stepping motor is so selected, and its drive circuitry so programmed, that the required stepping movement is produced.

In either embodiment with an AC synchronous or a stepping motor, the physical arrangement would be as shown on FIG. 5 with the cam 28 and the limit switch 29 being unnecessary.

In one construction of the present invention, employing an electromechanical detent mechanism essentially as described, applied to an adjustable autotransformer of the same physical size as a conventional unit rated at 28 amperes output for a given temperature rise, the improved transformer averaged 47.5 amperes output at the same temperature rise. Thus, the invention produced an increase in output of 70 percent.

Since certain changes may be made in carrying out the above described invention without departing from the scope thereof, it is intended that all matter contained in the above description or shown in the accompanying Drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. An adjustable voltage transformer, comprising:

(a) an electrically conductive coil wound upon a magnetic core and having upon the coil a commutating surface corresponding to the path of a contact brush in electrical engagement therewith, the commutating surface being formed of a succession of exposed segments of the windings of the coil, and the brush being sized such that it is alternatingly in engagement with one or two of the segments;

(b) an internally threaded guide to which the brush is fixedly attached;

(c) a threaded lead screw passing through and mechanically cooperating with the guide;

(d) electric motor means to rotate the lead screw to move the guide, causing the brush to move a selected direction along the commutating surface; and (e) control means to cause the motor means to provide rotation in the desired direction and to cause the brush to be in contact with only one segment when the brush is at rest.

2. The adjustable voltage transformer, as defined in claim 1, wherein:

the electric motor means comprises an AC synchronous motor constructed so that when a DC current is applied to its stator windings, its rotor will be held at a position mechanically corresponding to the brush being positioned in contact with only one segment.

3. The adjustable voltage transformer, as defined in claim 1, wherein:

the electric motor means comprises a stepping motor.

* * * * *